US010034077B2

(12) United States Patent
Liu et al.

(10) Patent No.: US 10,034,077 B2
(45) Date of Patent: Jul. 24, 2018

(54) EARPHONE CONTROL METHOD, EARPHONE CONTROL SYSTEM AND EARPHONE

(71) Applicant: Goertek Inc., Weifang (CN)

(72) Inventors: Song Liu, Weifang (CN); Shasha Lou, Weifang (CN); Bo Li, Weifang (CN); Hui Qi, Weifang (CN)

(73) Assignee: GOERTEK INC., Weifang, Shandong Province (CN)

( * ) Notice: Subject to any disclaimer, the term of this patent is extended or adjusted under 35 U.S.C. 154(b) by 0 days.

(21) Appl. No.: 15/312,435

(22) PCT Filed: Jul. 21, 2016

(86) PCT No.: PCT/CN2016/090873
§ 371 (c)(1),
(2) Date: Nov. 18, 2016

(87) PCT Pub. No.: WO2017/113768
PCT Pub. Date: Jul. 6, 2017

(65) Prior Publication Data

US 2018/0091886 A1 Mar. 29, 2018

(30) Foreign Application Priority Data

Dec. 29, 2015 (CN) ..... 2015 1 1022273

(51) Int. Cl.
*H04R 1/00* (2006.01)
*H04R 1/10* (2006.01)
(Continued)

(52) U.S. Cl.
CPC ..... *H04R 1/1041* (2013.01); *G08B 21/182* (2013.01); *G10K 11/178* (2013.01);
(Continued)

(58) Field of Classification Search
CPC ..... H04R 1/1041; H04R 2420/07; H04R 2430/01; H04R 2460/01; H04R 2460/07;
(Continued)

(56) References Cited

U.S. PATENT DOCUMENTS 5,388,992 A 2/1995 Franklin et al.
5,610,848 A 3/1997 Forwell
(Continued)

FOREIGN PATENT DOCUMENTS

CN 1378898 A 11/2002
CN 103793050 A 5/2014
(Continued)

OTHER PUBLICATIONS

Written Opinion (PCT/ISA/237) dated Oct. 11, 2016, by the State Intellectual Property Office of the P.R.C. for International Application No. PCT/CN2016/090873.
(Continued)

*Primary Examiner* — Vivian Chin
*Assistant Examiner* — Friedrich W Fahnert
(74) *Attorney, Agent, or Firm* — Buchanan Ingersoll & Rooney PC

(57) ABSTRACT

An earphone control method, an earphone control system and an earphone. The earphone control method includes: selecting a motion state judgement parameter of a wearer for controlling an earphone and setting an alert condition according to the selected motion state judgement parameter; real-timely monitoring and acquiring behavior data of the earphone wearer; calculating the motion state judgement parameter by using the acquired behavior data to obtain a motion state judgement parameter value; and judging whether or not the motion state judgement parameter value satisfies the alert condition; if the motion state judgement parameter value satisfies the alert condition, determining to
(Continued)

enter an earphone alert state and controlling to perform corresponding alert operation on the earphone.

14 Claims, 4 Drawing Sheets

(51) Int. Cl.
*G10K 11/178* (2006.01)
*G08B 21/18* (2006.01)

(52) U.S. Cl.
CPC .. *G10K 2210/1081* (2013.01); *H04R 2420/07* (2013.01); *H04R 2430/01* (2013.01); *H04R 2460/01* (2013.01); *H04R 2460/07* (2013.01)

(58) Field of Classification Search
CPC ..... G08B 21/182; G10K 11/178; G10K 2210/1081
USPC ..... 381/74; 340/6.1, 6.11, 6.13, 7.38, 7.39, 340/7.58, 7.62, 10.5
See application file for complete search history.

(56) References Cited

U.S. PATENT DOCUMENTS

| | | | | |
|---|---|---|---|---|
| 6,850,151 | B1 * | 2/2005 | Calhoun | G04G 13/021 340/309.16 |
| 7,346,172 | B1 * | 3/2008 | Begault | H04R 27/00 340/384.5 |
| 9,552,066 | B2 | 1/2017 | Taninaka et al. | |
| 9,606,628 | B2 | 3/2017 | Taninaka et al. | |
| 9,918,154 | B2 | 3/2018 | Timothy et al. | |
| 2002/0051332 | A1 | 5/2002 | Miyajima et al. | |
| 2006/0119573 | A1 | 6/2006 | Grant et al. | |
| 2006/0139840 | A1 | 6/2006 | Yasuda et al. | |
| 2007/0092087 | A1 * | 4/2007 | Bothra | H04M 1/6058 381/74 |
| 2013/0106589 | A1 | 5/2013 | Posamentier | |
| 2013/0106756 | A1 | 5/2013 | Kono et al. | |
| 2013/0165226 | A1 | 6/2013 | Thorner | |
| 2014/0028547 | A1 | 1/2014 | Bromley et al. | |
| 2014/0118126 | A1 | 5/2014 | Garg et al. | |
| 2015/0332565 | A1 | 11/2015 | Cho et al. | |
| 2016/0234588 | A1 | 8/2016 | Timothy et al. | |
| 2016/0300388 | A1 | 10/2016 | Stafford et al. | |
| 2017/0034612 | A1 | 2/2017 | Timothy et al. | |
| 2017/0156662 | A1 | 6/2017 | Goodall et al. | |
| 2017/0182517 | A9 | 6/2017 | Houston et al. | |
| 2017/0188129 | A1 * | 6/2017 | Sindia | H04R 1/1041 |

FOREIGN PATENT DOCUMENTS

| | | | |
|---|---|---|---|
| CN | 104954566 | A | 9/2015 |
| CN | 204760039 | U | 11/2015 |
| CN | 1050287418 | A | 11/2015 |
| CN | 205485661 | U | 8/2016 |
| CN | 205581671 | U | 9/2016 |
| JP | H10-240354 | A | 9/1998 |

OTHER PUBLICATIONS

Office Action (The First Office Action) dated May 22, 2017, by the State Intellectual Property Office of the People's Republic of China in Chinese Patent Application No. 201511031780.7 and an English Translation of the Office Action. (16 pages).

Office Action (The First Office Action) dated May 27, 2017, by the State Intellectual Property Office of the People's Republic of China in Chinese Patent Application No. 201511031603.9 and an English Translation of the Office Action. (19 pages).

Niu P. et al."Process Control System" Electronic Industry Press, pp. 298-302, Jun. 30, 2011.

Written Opinion of the International Searching Authority (Form PCT/ISA/237) dated Sep. 21, 2016, by the State Intellectual Property Office of the P.R.C., in the International Application No. PCT/CN2016/086931. (10 pages).

Office Action issued by the U.S. Patent and Trademark Office in the U.S. Appl. No. 15/324,151, dated Apr. 18, 2018, U.S. Patent and Trademark Office, Alexandria, VA. (16 pages).

* cited by examiner

EARPHONE CONTROL METHOD, EARPHONE CONTROL SYSTEM AND EARPHONE

TECHNICAL FIELD

The present disclosure relates to the technical field of earphone, and particularly, to an earphone control method, an earphone control system and an earphone.

BACKGROUND

Currently, when wearing an earphone, such as an Active Noise Cancellation (ANC) earphone, the user hears low environmental noises due to the strong noise cancellation function of the ANC earphone, and thus the user is not so sensitive to alert sounds (e.g., automobile horn honking) in the external environment, and alerts are identified more visually. However, if the wearer is quickly walking, running or violently acting, his ability to visually identify alerts is weakened, which may bring dangers to the wearer.

SUMMARY OF THE DISCLOSURE

The embodiments of the present disclosure provide an earphone control method, so as to solve the problem that the existing earphones may bring dangers to the user in some application scenes because the user hears too low environmental sounds. In addition, the present disclosure provides an earphone to which the control method of the present disclosure is applied and an earphone control system.

According to an aspect of the present disclosure, there is provided an earphone control method, comprising:

selecting a motion state judgement parameter of a wearer for controlling an earphone, and setting an alert condition according to the selected motion state judgement parameter;

real-timely monitoring and acquiring behavior data of the earphone wearer;

calculating the motion state judgement parameter by using the acquired behavior data to obtain a motion state judgement parameter value; and judging whether or not the motion state judgement parameter value satisfies the alert condition; if the motion state judgement parameter value satisfies the alert condition, determining to enter an earphone alert state and controlling to perform corresponding alert operation on the earphone.

According to another aspect of the present disclosure, there is provided an earphone, wherein an acceleration sensor or Global Positioning System (GPS) positioner is disposed at a position on the earphone contacting a wearer's head, and the earphone further comprises: an alert judgement unit connected to the acceleration sensor or GPS positioner, and an alert execution unit connected to the alert judgement unit;

the acceleration sensor or GPS positioner real-timely monitors and acquires behavior data of an earphone wearer;

the alert judgement unit calculates a selected motion state judgement parameter by using the acquired behavior data to obtain a motion state judgement parameter value, judges whether or not the motion state judgement parameter value satisfies a preset alert condition, and outputs a judgement result to the alert execution unit; and the alert execution unit determines to enter an earphone alert state and controls to perform corresponding alert operation on the earphone according to the judgement result, when the motion state judgement parameter value satisfies the alert condition.

According to still another aspect of the present disclosure, there is provided an earphone control system, comprising na earphone and a wearable device wirelessly connected to the earphone;

the wearable device is provided with an acceleration sensor or Global Positioning System (GPS) positioner; and further comprises a processor connected to the acceleration sensor or GPS positioner, and a wireless communication unit connected to the processor;

the acceleration sensor or GPS positioner real-timely monitors and acquires behavior data of the earphone wearer, and outputs the behavior data to the processor;

the processor calculates a selected motion state judgement parameter by using the acquired behavior data to obtain a motion state judgement parameter value, judges whether or not the motion state judgement parameter value satisfies a preset alert condition, and when the motion state judgement parameter value satisfies the alert condition, determines to enter an earphone alert state, and sends an instruction of performing corresponding alert operation to the earphone while outputting reminder information to the earphone wearer; and the earphone receives the instruction of performing corresponding alert operation, and performs corresponding alert operation according to the instruction.

The present disclosure achieves following beneficial effects: the earphone control method in the embodiments of the present disclosure selects a motion state judgement parameter of a wearer for controlling an earphone, sets an alert condition according to the selected motion state judgement parameter, and determines to enter an earphone alert state and controls to perform corresponding alert operation on the earphone if the wearer determines that the current motion state judgement parameter value satisfies the alert condition. Thus, the earphone is controlled to perform corresponding alert operation according to the change of the user's motion state, so that the earphone wearer can be reminded or the hearable environment sound can be enhanced when the earphone wearer is in a distractive dangerous environment (e.g., fast running), thereby improving the user's ability to identify dangers in the environment, solving the problem in the prior art that the earphone may bring dangers to the wearer in some application scenes, enriching the functions of the earphone, making the earphone more intelligent, ensuring the security of the wearer, and improving the user's usage experience.

In addition, the embodiments of the present disclosure further provide an earphone, which judges whether or not to perform an alert operation according to the wearer's current motion state, and determines whether or not to enter the earphone alert state and control to perform corresponding alert operation on the earphone, thereby improving the security when the user wears the earphone. Finally, the present disclosure provides an earphone control system which controls to take corresponding alert operation, thereby enhancing the earphone wearer's ability to identify any danger in the environment, and preventing the occurrence of dangers.

DETAILED DESCRIPTION

The design concept of the present disclosure is made with respect to the problem that in the prior art, the wearer of the earphone is not sensitive to the external environmental sounds on specific use occasions, and potential safety hazards may be brought to the wearer. By monitoring motion state parameters of a user who wears the earphone, and controlling to perform corresponding alert operation on the earphone when it is determined that a motion state parameter satisfies the alert condition, the earphone wearer's ability to identify dangers in the environment is enhanced, the occurrence of danger is prevented, and the user's usage experience is improved. Practice has proved that this solution can in time detect and switch to the alert state when the motion state of the earphone wearer is changed, and achieve good accuracy and real-time capability.

Embodiment 1

Figure 1:
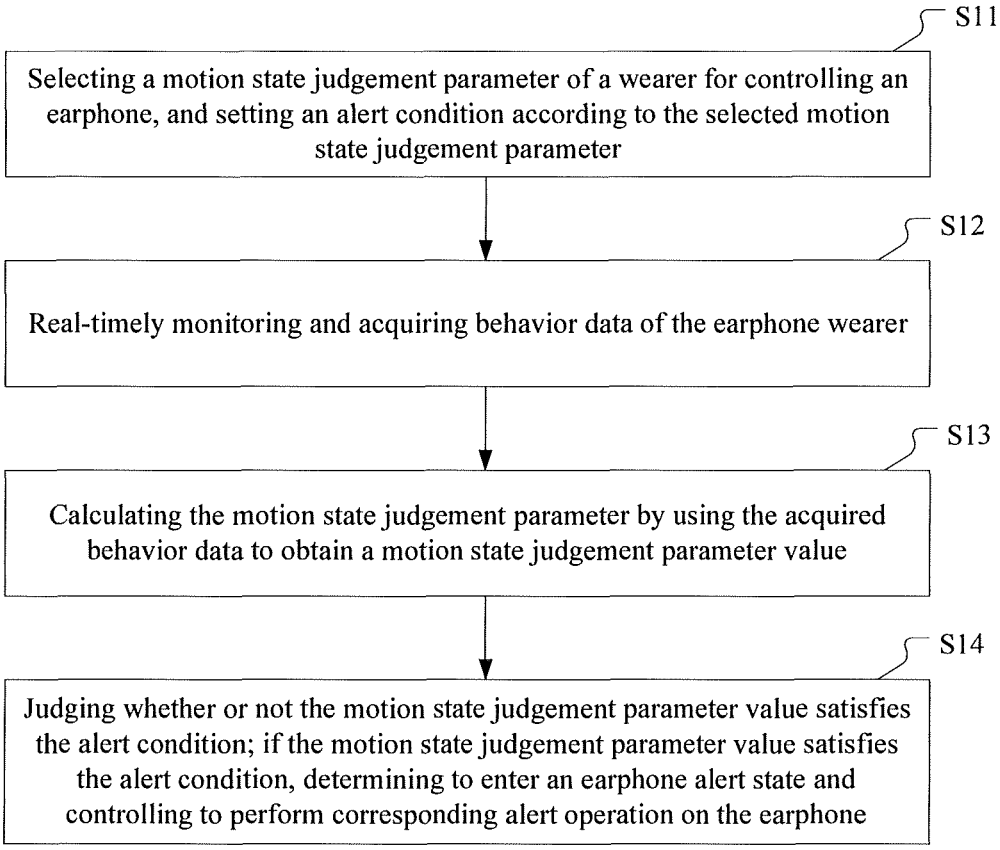
FIG. 1 is a flow diagram of an earphone control method in an embodiment of the present disclosure.

FIG. 1 is a flow diagram of an earphone control method in an embodiment of the present disclosure. Referring to FIG. 1, the method comprises Step S11 to Step S14:

Step S11: selecting a motion state judgement parameter of a wearer for controlling an earphone, and setting an alert condition according to the selected motion state judgement parameter;

Step S12: real-timely monitoring and acquiring behavior data of the earphone wearer;

Step S13: calculating the motion state judgement parameter by using the acquired behavior data to obtain a motion state judgement parameter value;

Step S14: judging whether or not the motion state judgement parameter value satisfies the alert condition; if the motion state judgement parameter value satisfies the alert condition, determining to enter an earphone alert state and controlling to perform corresponding alert operation on the earphone.

In one manner, Steps S11 to S14 can be carried out in the same device such as a smart earphone, or carried out in a smart watch or a smart bracelet which controls the earphone to perform the alert operation. In another manner, Steps S11 to S14 can also be carried out in different devices. For example, Steps S11 to S13 are carried out in a smart watch, which transfers the obtained motion state judgement parameter value to the earphone, so that the earphone performs Step S14. The manner specifically adopted may be adjusted based on the actual scene, and is not strictly limited herein.

The corresponding alert operation in Step S14 includes one or more of the following alert operations:

Alert operation 1: lowering a noise cancellation level of Active Noise Cancellation (ANC) in the earphone.

If an ANC earphone is wore, the earphone wearer can hear more alert sounds by lowering the noise cancellation level of Active Noise Cancellation in the ANC earphone, thereby improving the wearer's ability to identify dangers. The noise cancellation level is classified based on the strength of the noise cancellation effect of the earphone. The strength of the noise cancellation effect of the earphone increases when the noise cancellation level rises, and correspondingly, the earphone wearer hears less external noises.

Alert operation 2: increasing a gain of a Talk Through function of the earphone.

Many existing earphones are provided with the Talk Through function. When the Talk Through function is activated, the earphone turns on an exterior microphone so that the earphone wearer can hear the external sounds without taking off the earphone.

Alert operation 3: decreasing a volume of an audio played in the earphone.

If the volume of the audio currently played in the earphone is too large, the wearer may not hear the external alert sound and encounter dangers. Thus when it is determined to enter the alert state, the wearer's ability to identify dangers may also be improved by decreasing the volume of the audio played in the earphone.

Alert operation 4: outputting reminder information to the wearer.

For example, a reminder may be sent to the earphone wearer. One manner of sending a reminder to the earphone wearer may be controlling a vibration element disposed in the earphone to make a vibration of a corresponding frequency to warn the wearer of dangers when it is determined to enter the alert state. Alternatively, the response of a wearable device, which is adaptive to the earphone, to a reminder such as an incoming call, a short message, etc. may be adjusted, e.g., controlling the vibration alert and the tone alert of the wearable device to be enhanced, so that the user in motion can still accurately sense the reminder.

The method as illustrated in FIG. 1 real-timely monitors and acquires behavior data of the earphone wearer, calculates according to those behavior data to obtain a motion state judgement parameter value, compares the motion state judgement parameter value with an alert condition, and if the motion state judgement parameter value satisfies the alert condition, determines to enter an earphone alert state, and controls to perform corresponding alert operation on the earphone, so as to improve the earphone wearer's ability to identify the danger alert information in the environment on specific occasions (e.g., occasions such as running and violent motion which are not sensitive to dangers), and prevent the occurrence of dangers.

Embodiment 2

Figure 2:
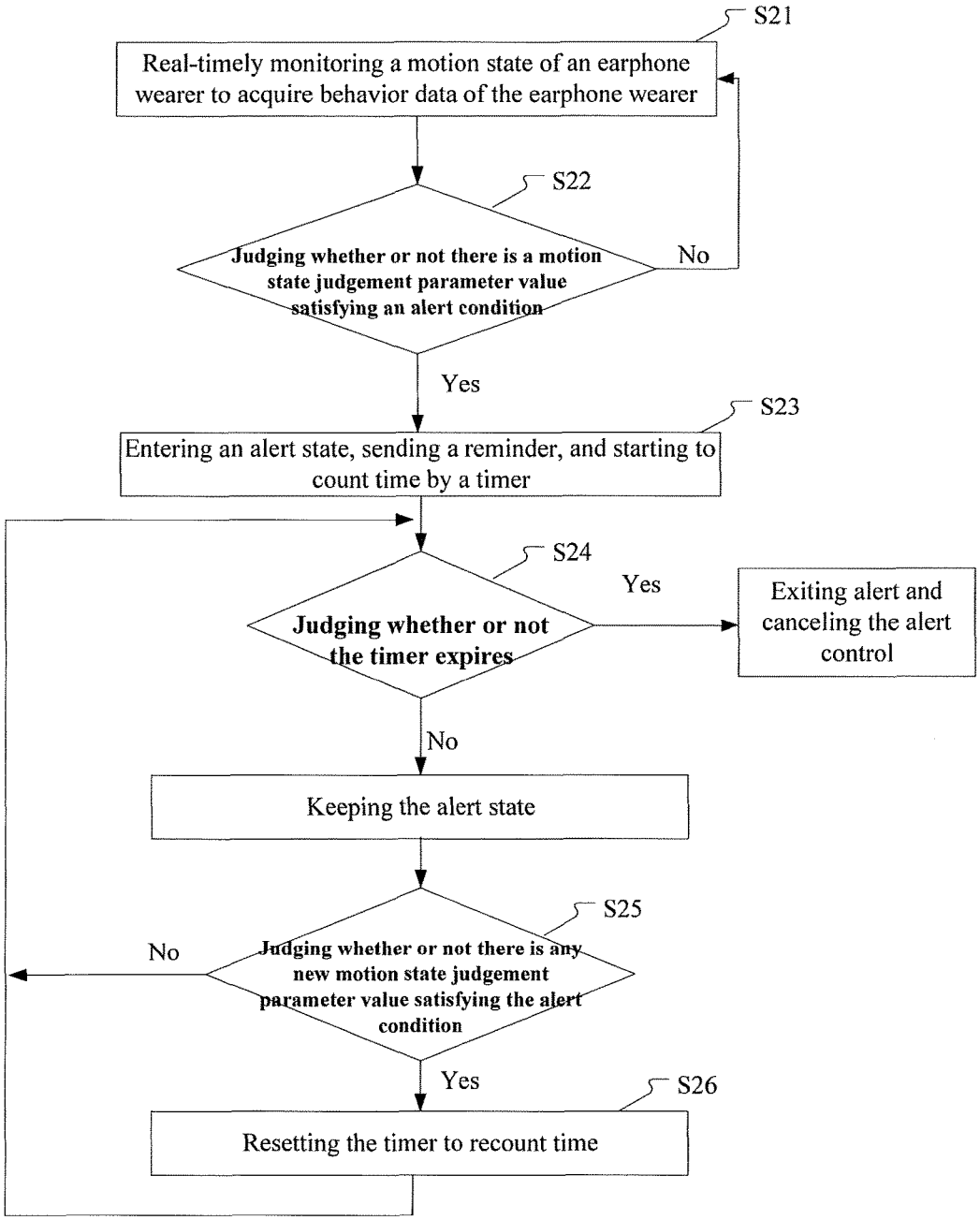
FIG. 2 is a flow diagram of an earphone control method in another embodiment of the present disclosure.

FIG. 2 is a flow diagram of an earphone control method in another embodiment of the present disclosure. Referring to FIG. 2, an earphone control method in this embodiment comprises Step S21 to Step S26:

Step S21: real-timely monitoring a motion state of an earphone wearer to acquire behavior data of the earphone wearer; and next, entering Step S22.

Specifically, the real-timely monitoring and acquiring behavior data of the earphone wearer may be implemented in two manners. The first manner is to real-timely monitor and acquire tri-axial acceleration data of motion behaviors of the earphone wearer through a tri-axial acceleration sensor. The second manner is to real-timely monitor and acquire displacement data of the earphone wearer through a Global Positioning System (GPS) positioner.

In this embodiment, detailed descriptions are made through an example in which a tri-axial acceleration sensor is disposed on the earphone to acquire the acceleration data by the tri-axial acceleration sensor. Preferably, the acceleration sensor is disposed at a position on the earphone contacting the user's head, such as the position of a speaker of an earphone or the position of an earmuff of a headphone, but not limited thereto. The tri-axial acceleration sensor may be disposed on other parts of the wearer's body, such as in the smart watch, or on the wearer's wrist, which is not limited.

Step S22: judging whether or not there is a motion state judgement parameter value satisfying an alert condition; and if so, entering Step S23, or otherwise returning to Step S21;

In this step, firstly the motion state judgement parameter value is calculated according to the tri-axial acceleration data acquired in Step S21; and next, the motion state judgement parameter value is compared with the alert condition to judge whether or not there is a motion state judgement parameter value satisfying an alert condition.

In which, the motion state judgement parameters include one or more of step speed, step frequency, step length and signal energy. An alert threshold is set for each selected motion state judgement parameter. The generally principle of alert condition setting is setting the alert condition as that the motion state judgement parameter value is larger than the alert threshold.

Schematic descriptions are given as follows by selecting the step frequency motion state judgement parameter as an example of motion state judgement parameter.

In the actual calculation, the method may calculate a step number of the wearer by using the tri-axial acceleration data acquired in Step S21, or X axis and Y axis acceleration data in the tri-axial acceleration data, calculate an average walking cycle of the wearer according to the step number and a signal sampling time duration, and calculate a first step frequency value according to the average walking cycle;

obtain a second step frequency value by calculating the step number within a selected time duration by using the acquired tri-axial acceleration data or the X axis and Y axis acceleration data in the tri-axial acceleration data; and next, compare the first step frequency value and the second step frequency value, and take a smaller one of the first step frequency value and the second step frequency value as a step frequency motion state judgement parameter value.

Specifically, the calculating a step number of the wearer by using the X axis and Y axis acceleration data in the tri-axial acceleration data, calculating an average walking cycle of the wearer according to the step number and a signal sampling time duration, and calculating a first step frequency value according to the average walking cycle comprises:

The first step frequency value is calculated through the following formula:

$$T = \frac{\sum_{i=1}^{M} T_{sample} * N_i}{M}$$

wherein, $T_{sample}$ is the signal sampling time duration and it is a known value, $N_i$ is the number of sampling points when the wearer walks to the $i^{th}$ step and it can be obtained in the step counting process, and M is the step number. The average walking cycle T can be obtained by calculating the average value for the M steps. After the average walking cycle T is obtained, a first walking frequency value $F_1$ is obtained by calculating the reciprocal of the average walking cycle T, i.e., $F_1=1/T$.

The calculating the second step frequency value by calculating the step number within a selected time duration by using the X axis and Y axis acceleration data in the tri-axial acceleration data comprises:

measuring M steps within the selected time duration T, and calculating $F_2=M/T$ to obtain the second step frequency value $F_2$.

Two walking frequency values (i.e., the first step frequency value and the second step frequency value) are obtained by the above two methods. Next, the two walking frequency values are compared with each other, and the smaller one is selected as the step frequency motion state judgement parameter value. That is, this embodiment takes the lower limit to ensure the accuracy of the step frequency value.

The calculation of the step number according to the acquired tri-axial acceleration data is the prior art, and any feasible technical means in the prior art may be adopted, which is omitted in this embodiment. To be emphasized, as compared with the existing solution that counts steps by using the tri-axial acceleration data, this embodiment makes an optimization. For example, the X axis and Y axis acceleration data in the tri-axial acceleration data are preferably used to calculate the step number. In some scenes, the step number even can be calculated by using the single-axial acceleration data rather than the tri-axial acceleration data, because by analyses the inventor finds that different from the situation that a wrist motion reflects the human body's motion state, the human body is usually in a violent motion state when the head motion is violent, and the component energy of a stride of the head motion is obviously less than that of a step. Thus the required step counting effect can be achieved in this embodiment just by using the modulus of the signals of the X axis and the Y axis in the tri-axis acceleration signals as the input of the step counting module, and the Z-axis signal, which has a higher stride frequency component, is no longer used, so as to reduce the computation burden and improve the processing speed.

The method, after obtaining the step frequency motion state judgement parameter value, compares the step frequency motion state judgement parameter value with the alert condition, and judges whether or not there is a motion state judgement parameter value satisfying the alert condition.

The processing logic of this embodiment is determining to enter the alert state when the action state of the earphone wearer presents some features related to high-speed walking or violent motion.

Figure 3:
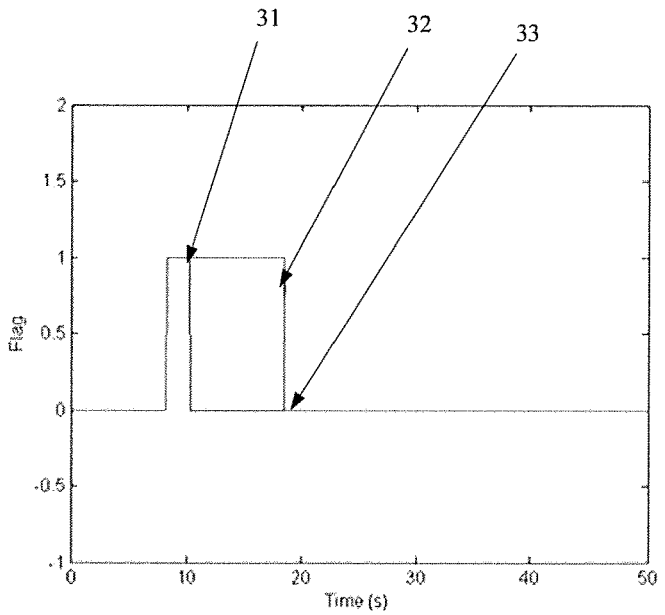
FIG. 3 is a schematic diagram of a change process of an alert state in an embodiment of the present disclosure.

FIG. 3 is a schematic diagram of a change process of an alert state in an embodiment of the present disclosure. Referring to FIG. 3, the change of the alert state includes entering alert 31, keeping alert 32 and exiting alert 33.

Entering alert 31: the alert condition varies with the selected motion state judgement parameter. For example, a single judgement logic may be set by using any one of the step speed, the step frequency, the step length and the signal energy. If the step frequency judgement is adopted, it is determined to enter alert when the step frequency motion state judgement parameter value is higher than a preset frequency threshold (e.g., an average step frequency 2 Hz of natural walking); if the step speed judgement is adopted, it is determined to enter alert when the step speed motion state judgement parameter value is higher than a preset step speed threshold (e.g., an average step speed 5 Km/h of natural walking); and if the signal energy judgement is adopted, it is determined to enter alert when the signal energy is higher than a preset energy threshold (e.g., an average signal energy of natural walking; for instance, with regard to an acceleration sensor, when 0 dB is marked as the square of the gravity acceleration, the average signal energy of the acceleration sensor during natural walking is −28 dB). When it is determined to enter alert, a maker "Enter Alert" may be set for the convenience of recording and operation. In practical application, the judgement should be made according to the result of the comparison between the calculated motion state judgement parameter value and corresponding alert condition.

If there is a motion state judgement parameter value satisfying the alert condition, Step S23 will be performed.

Note: referring to FIG. 3, the earphone in FIG. 3 enters the alert state at the moment of 10 s. But in practical application, the judgement of needing to enter the alert state may be made before the moment of 10 s, but certain response time may be required from making a judgement to the successful control of the earphone to execute an alert. It should be appreciated that the length of the response time is not limited to 10 s herein, and it can be reduced as far as possible by adjusting the performance of the whole system.

Step S23: entering the alert state, sending a reminder, and starting to count time by a timer; and next, entering Step S24.

In Step S23, the method, after determining to enter the alert state, sends reminder information to the earphone wearer so that the wearer pays attention to the dangerous factors in the external environment, and starts timing from a time moment of determining to enter a earphone alert state, and obtains a current alert time length.

Step S24: judging whether or not the timer expires; if so, exiting the alert and canceling the alert control, or otherwise keeping the alert state.

In Step S24, the judging whether or not the timer expires specifically comprises: comparing the current alert time length obtained in Step S23 with a preset time threshold; if the current alert time length is larger than or equal to the time threshold, determining to exit the earphone alert state and cancelling corresponding alert operation; and if the current alert time length is less than the time threshold, keeping the alert state and performing Step S25.

The function of the timer is to balance the normal use of the earphone and the alert execution. If the marker "Enter Alert" does not occur within a continuous period of time, it means that the wearer is in a relatively safe environment during the period of time, and thus the alert may be exited temporarily and the normal use of the earphone can be recovered.

Step S25: judging whether or not there is any new motion state judgement parameter value satisfying the alert condition; if so, performing Step S26, or otherwise returning to Step S24.

That is, under the condition that the timer does not expire, it is further judged whether or not there is any new motion state judgement parameter value satisfying the alert condition in the current alert time length, and if so, Step S26 will be performed.

Step S26: resetting the timer to recount timing.

That is, in Step S25, if it is determined that there is a new motion state judgement parameter value satisfying the alert condition, it means that at least one marker "Enter Alert" occurs within a continuous period of time, and the wearer is still in a relatively dangerous environment, so the method recounts time from a current alert time point; or otherwise, returns to Step S24 to compare the current alert time length with the preset time threshold.

As can be seen from FIGS. 2 and 3, in the earphone control method of this embodiment, the change process of the alert state is: entering alert if there is a motion state judgement parameter value satisfying the alert condition; keeping the alert state if at least one marker "Enter Alert" occurs within a continuous period of time; and exiting the alert if the marker "Enter Alert" does not occur within a continuous period of time.

Embodiment 3

In this embodiment, emphases are laid on the alert condition classification and the judgement process for each level. Please refer to other embodiments of the present disclosure for other contents.

In the motion process of a user wearing the earphone, the danger level varies with the motion state, and thus it may be considered to set different levels for the alert conditions according to the motion states of the earphone wearer, so as to further optimize the user's usage experience.

Specifically, the method may set a plurality of different alert thresholds for each of the motion state judgement parameters, and set alert conditions of different levels according to the different alert thresholds. For example, a first-level alert threshold and a second-level alert threshold are set for the motion state judgement parameters, the alert condition includes a first-level alert condition and a second-level alert condition, a motion state parameter value in the first-level alert condition is set to be larger than the first-level alert threshold and less than the second-level alert threshold, and a motion state parameter value in the second-level alert condition is set to be larger than the second-level alert threshold. If the motion state judgement parameter value satisfies the alert condition, the method determines to enter the earphone alert state and controls to perform corresponding alert operation on the earphone. That comprises: if the motion state judgement parameter value satisfies the first-level alert condition, determining to enter a first-level alert state and controlling to perform corresponding alert operation on the earphone; and if the motion state judgement parameter value satisfies the second-level alert condition, determining to enter a second-level alert state and controlling to perform corresponding alert operation on the earphone.

In that, when the earphone wearer is in the running motion state, the signal energy and the step frequency are both obviously higher than those in the walking state. Thus in this embodiment, two motion state judgement parameters, i.e., the step frequency and the signal energy, are used to distinguish the running state from the walking state, and alert conditions of corresponding levels are set respectively, so that the judgement of the alert state is more elaborate and accurate.

In practical application, when it is detected that the wearer is in the violent motion state (e.g., running), running is set as the second-level alert, and fast walking is set as the first-level alert. For example, if the step frequency judgement is adopted, it is determined to enter the first-level alert when the step frequency of the wearer is higher than a walking frequency threshold and lower than a running frequency threshold, and it is determined to enter the second-level alert when the step frequency of the wearer is higher than the running frequency threshold.

Correspondingly, the alert operation may also be adaptive to the alert level. In an example of controlling the Talk Through function of the earphone, the gain of Talk Through can be adjusted continuously and smoothly varied with the entered alert level:

adjusting the gain of Talk Through to be the maximum when it is determined to enter the second-level alert;

adjusting the gain of Talk Through to be medium when it is determined to enter the first-level alert; and the gain of Talk Through being 0 (dB) when there is no alert.

By setting the different alert levels, and performing corresponding alert operation when entering the alert state of each level, the earphone control method in this embodiment is more elaborate and accurate, thereby improving the user's usage experience.

Embodiment 4

This embodiment is described through a solution which makes a joint judgement by using a plurality of motion state judgement parameters and a plurality of levels of alert thresholds. Please refer to other embodiments of the present disclosure for other contents. The joint judgement can be made by using two or more motion state judgement parameters simultaneously, and two or more levels of alert thresholds are set for each of the motion state judgement parameters.

Figure 4:
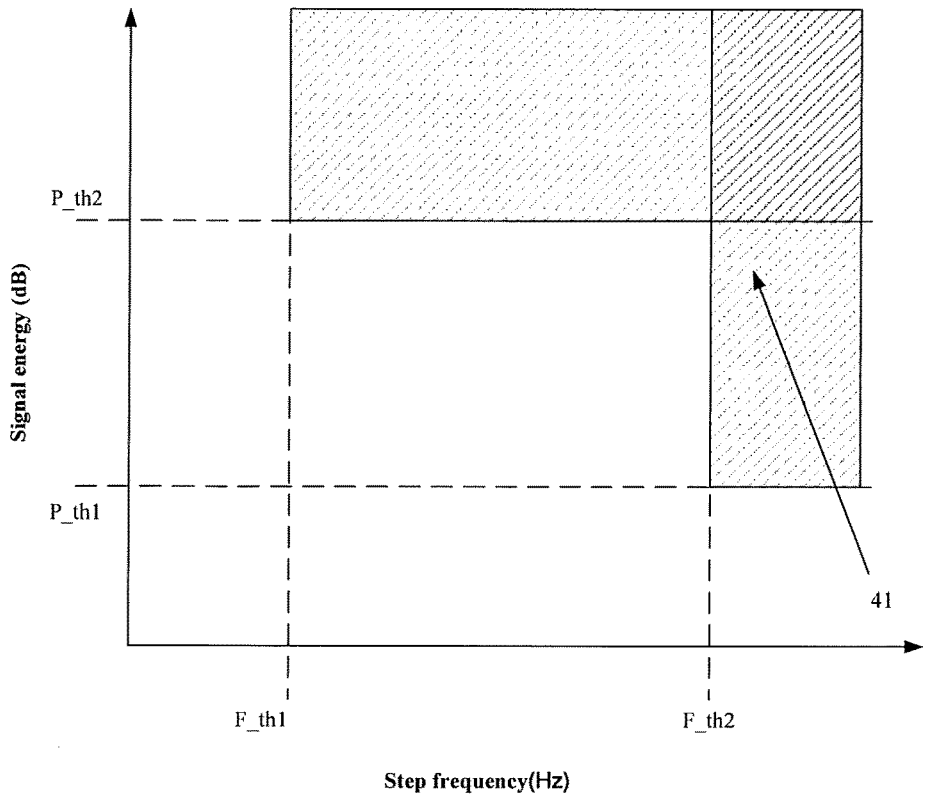
FIG. 4 is a principle diagram of a joint judgement that is made by selecting a step frequency as a first motion state judgement parameter and signal energy as a second motion state judgement parameter in another embodiment of the present disclosure.

FIG. 4 is a principle diagram of a joint judgement that is made by selecting a step frequency as a first motion state judgement parameter and signal energy as a second motion state judgement parameter in another embodiment of the present disclosure. Optionally, a first-level alert threshold and a second-level alert threshold are set for a step frequency motion state judgement parameter and a signal energy motion state judgement parameter respectively.

To be noted, the signal energy is equal to the quadratic sum of a signal. For example, when the bi-axial acceleration data of the tri-axial acceleration data are used for the calculation, the signal energy Energy (t) at the moment t is calculated in the following formula:

$$\text{Energy}(t)=x^2(t)+y^2(t).$$

In that, x(t) is the X-axial acceleration signal at the moment t, and y(t) is the Y-axial acceleration signal at the moment t.

Next, the first alert condition is set as that the step frequency motion state judgement parameter value is larger than the step frequency second-level alert threshold, and the signal energy motion state judgement parameter value is larger than the signal energy first-level alert threshold; and the second alert condition is set as that the step frequency motion state judgement parameter value is larger than the step frequency first-level alert threshold, and the signal energy motion state judgement parameter value is larger than the signal energy second-level alert threshold; wherein the second-level alert threshold of the step frequency motion state judgement parameter is larger than the first-level alert threshold of the step frequency motion state judgement parameter, and the second-level alert threshold of the signal energy motion state judgement parameter is larger than the first-level alert threshold of the signal energy motion state judgement parameter.

Specifically, the condition for judging whether or not to enter the alert state is: if the step frequency motion state judgement parameter value and the signal energy motion state judgement parameter value satisfy the first alert condition or the second alert condition, determining to enter the earphone alert state and controlling to perform corresponding alert operation on the earphone.

Referring to the joint judgement process of the two parameters shown in FIG. 4, the first alert condition is that the step frequency motion state judgement parameter value is higher than the step frequency second-level alert threshold F_th2, and the signal energy motion state judgement parameter value is higher than the signal energy first-level alert threshold P_th1;

the second alert condition is that the step frequency motion state judgement parameter value is higher than the step frequency first-level alert threshold F_th1, and the signal energy motion state judgement parameter value is higher than the signal energy second-level alert threshold P_th2;

and if either of the two alert conditions is satisfied, it is determined to enter the earphone alert state; that is, if the current values of the two motion state judgement parameters, i.e., the step frequency of the earphone wearer and the signal energy, fall within the black shadow area denoted as 41 in FIG. 4, it is determined to enter the earphone alert state.

Referring to FIG. 4, in FIG. 4 F_th1<F_th2 and P_th1<P_th2. The signal energy thresholds P_th1 and P_th2, and the frequency thresholds F_th1 and F_th2 are all empirical values and can be obtained statistically.

The joint judgement also improves the accuracy of the earphone control method in this embodiment, and when the signal energy and the step frequency parameter values exceed their respective alert thresholds, a detection can be made in time and the alert state can be switched into. Experimental results show that the false alarm and the miss alarm are both very small (the miss alarm is less than 10%), and no false detection or missed detection will occur in the regions where the motion speed of the wearer is larger than 6 km/h and less than 3 km/h.

To be emphasized, FIG. 4 just illustrates an example of the joint judgement logic, and the joint judgement logic is not limited thereto. For example, when multiple alert levels are used, in other embodiments of the present disclosure, a signal energy third-level alert threshold P_th3 and a frequency third-level alert threshold F_th3 may be set, and an alert state of adaptive level is determined with reference to the level judgement process introduced in Embodiment 3. In addition, the joint judgement using the motion state judgement parameters is also not limited to the combination of the step frequency and the signal energy, and a joint judgement using other motion state judgement parameters may also be made, which can be specifically selected upon demand in practical application, which will not be in detail described Embodiment 5

Figure 5:
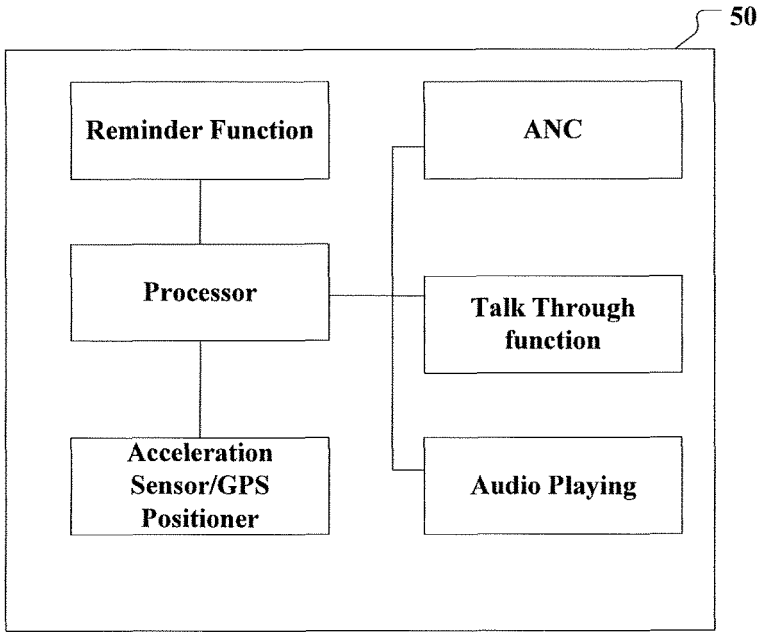
FIG. 5 is a structural block diagram of an earphone in another embodiment of the present disclosure.

FIG. 5 is a structural block diagram of an earphone in another embodiment of the present disclosure. Referring to FIG. 5, the earphone 50 is an ANC earphone. The earphone 50 comprises an acceleration sensor or a Global Positioning System (GPS) positioner disposed at a position on the earphone contacting the wearer's head, an alert judgement unit connected to the acceleration sensor or GPS positioner, and an alert execution unit connected to the alert judgement unit.

It should be appreciated that the functions of the alert execution unit and the alert judgement unit can be specifically implemented through the processor illustrated in FIG. 5.

The acceleration sensor or GPS positioner real-timely monitors and acquires behavior data of the earphone wearer;

the alert judgement unit calculates a selected motion state judgement parameter by using the behavior data acquired by the acceleration sensor to obtain a motion state judgement parameter value, judges whether or not the motion state judgement parameter value satisfies a preset alert condition, and outputs a judgement result to the alert execution unit; and the alert execution unit determines to enter an earphone alert state and controls to perform corresponding alert operation on the earphone according to the judgement result, when the motion state judgement parameter value satisfies the alert condition.

FIG. 5 illustrates several alert operations which can be performed: for example, lowering the noise cancellation level of ANC; or adjusting the gain of Talk Through, such as increasing the gain from 0 (dB) (i.e., activating Talk Through); or controlling the audio play function in the earphone, e.g., decreasing the volume of the played audio; or controlling the reminder function in the earphone to output reminder information to the wearer, etc. In addition, those alert operations herein may be in the relationship of logic AND, i.e., they can be performed simultaneously if there is no confliction, so as to enhance the user's ability to sense dangers and improve the security of earphone wearing.

Embodiment 6

Figure 6:
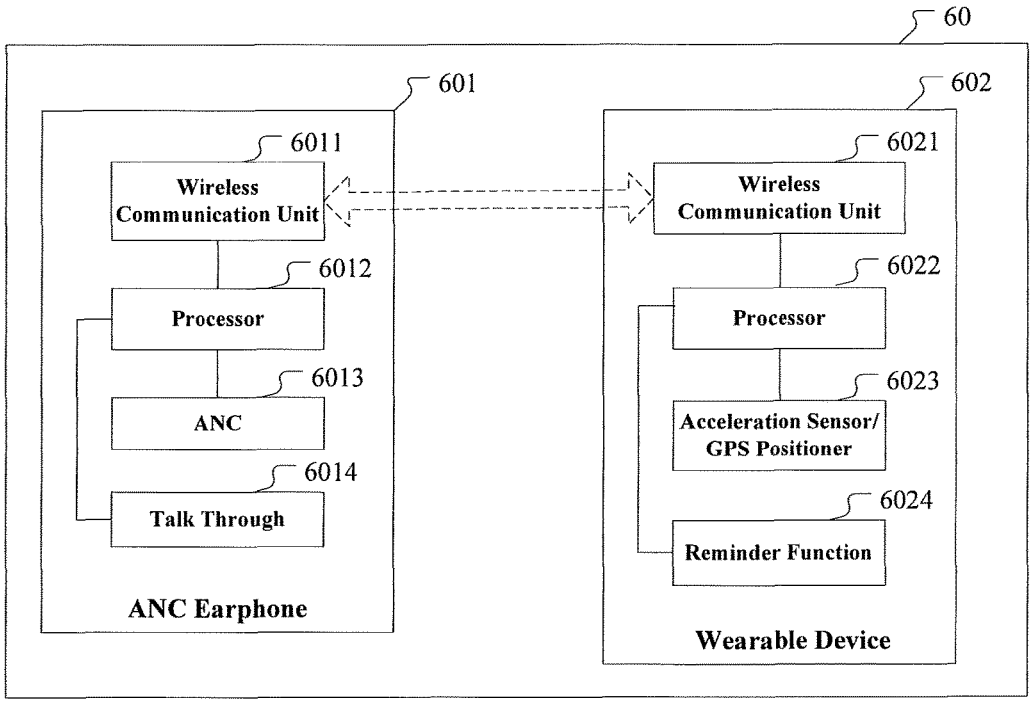
FIG. 6 is a structural block diagram of an earphone control system in another embodiment of the present disclosure.

FIG. 6 is a structural block diagram of an earphone control system in another embodiment of the present disclosure. Referring to FIG. 6, an earphone control system 60 comprises an earphone 601 and a wearable device 602 wirelessly connected to the earphone.

The wearable device 602 is provided with an acceleration sensor or GPS positioner 6023. In this embodiment, the wearable device 602 may be a smart watch, in which the acceleration sensor 6023 is disposed, and which is wore at the user's wrist.

The wearable device 602 further comprises a processor 6022 connected to the acceleration sensor or GPS positioner 6023, and a wireless communication unit 6021 (e.g., a wireless transmitter and receiver unit) connected to the processor 6022;

the acceleration sensor or GPS positioner 6023 real-timely monitors and acquires behavior data of the earphone wearer, and outputs the behavior data to the processor 6022;

the processor 6022 calculates a selected motion state judgement parameter by using the acquired behavior data to obtain a motion state judgement parameter value, judges whether or not the motion state judgement parameter value satisfies a preset alert condition, and when the motion state judgement parameter value satisfies the alert condition, determines to enter an earphone alert state, and sends an instruction of performing corresponding alert operation to the earphone 601 while outputting reminder information to the earphone wearer; and the earphone 601 receives the instruction of performing corresponding alert operation, and performs corresponding alert operation according to the instruction.

Referring to FIG. 6, the earphone 601 is an Active Noise Cancellation ANC earphone, which is provided with a wireless communication unit 6011, an ANC function 6013 and a Talk Through function 6014, wherein the wireless communication unit 6011 is connected to the wireless communication unit 6021 in the wearable device 602 to perform wireless data communications.

The working process of the earphone control system 60 is that: if the smart watch determines that the current motion state judgement parameter value of the earphone wearer satisfies the alert condition according to the behavior data acquired by the tri-axial acceleration sensor or GPS positioner 6023, and after enters the earphone alert state, the smart watch sends a control instruction to the earphone 601 through the wireless communication unit 6021, and simultaneously controls a reminder function 6024 in the smart watch to work, so as to output reminder information to the wearer of the smart watch. For example, reminder information indicating that the earphone enters the alert state may be output onto a user interface of the smart watch, or reminder information may be output to the wearer of the smart watch by intensifying the vibration alert or ring alert of the smart watch. Thus, by improving the alert ability of the wearer of the smart watch adaptive to the earphone, the occurrence of danger is reduced.

After the earphone 601 wirelessly communicated with the smart watch receives the control instruction from the smart watch, the processor 6022 of the earphone lowers the noise cancellation level of the ANC function 6013 in the earphone 601, and/or increases the gain of the Talk Though function 6014 of the earphone 601, and/or decreases the volume of the audio played in the earphone.

In this embodiment, the processor 6022 is specifically configured to select one or more of step speed, step frequency, step length and signal energy of the wearer as the motion state judgement parameters, set an alert threshold for each of the selected motion state judgement parameters, and set the alert condition as that the motion state judgement parameter value is larger than the alert threshold.

The processor 6022 is further configured to set a plurality of different alert thresholds for each motion state judgement parameter, and set alert conditions of different levels according to the different alert thresholds, wherein, a first-level alert threshold and a second-level alert threshold are set for the motion state judgement parameter, the alert condition includes a first-level alert condition and a second-level alert condition, a motion state parameter value in the first-level alert condition is set to be larger than the first-level alert threshold and less than the second-level alert threshold, and a motion state parameter value in the second-level alert condition is set to be larger than the second-level alert threshold; the processor 6022, if determining that the motion state judgement parameter value satisfies the first-level alert condition, determines to enter the first-level alert state, and sends an instruction of performing corresponding alert operation to the earphone 601 while outputting reminder information to the earphone wearer; and the processor 6022, if determining that the motion state judgement parameter value satisfies the second-level alert condition, determines to enter the second-level alert state, and sends an instruction of performing corresponding alert operation to the earphone 601 while outputting reminder information to the earphone wearer.

In this embodiment, the processor 6022 is specifically configured to set a first-level alert threshold and a second-level alert threshold for a first motion state judgement parameter and a second motion state judgement parameter respectively; set a first alert condition as that a first motion state judgement parameter value is larger than a second-level alert threshold, and a second motion state judgement parameter value is larger than the first-level alert threshold; and set a second alert condition as that the first motion state judgement parameter value is larger than the first-level alert threshold and the second motion state judgement parameter value is larger than the second-level alert threshold; wherein the second-level alert threshold of the first motion state judgement parameter is larger than the first-level alert threshold of the first motion state judgement parameter, and the second-level alert threshold of the second motion state judgement parameter is larger than the first-level alert threshold of the second motion state judgement parameter; and the processor 6022, if determining that the first motion state judgement parameter value and the second motion state judgement parameter value satisfy the first alert condition or the second alert condition, determines to enter the earphone alert state, and sends an instruction of performing corresponding alert operation to the earphone 601 while outputting reminder information to the earphone wearer.

To be noted, the earphone control system in this embodiment is corresponding to the earphone control method in the aforementioned embodiments. Thus please refer to the descriptions of related portions in the aforementioned embodiments for the detailed working process of the earphone control system in this embodiment, which will not be in detail described.

In summary, the earphone control method in the embodiment of the present disclosure selects a motion state judgement parameter for controlling an earphone wearer, and sets an alert condition according to the selected motion state judgement parameter; and determines to enter a earphone alert state and controls to perform corresponding alert operation on the earphone if the wearer determines that the current motion state judgement parameter value satisfies the alert condition. Thus, the earphone is controlled according to the change of the user's motion state, so that the alert operation is performed when the user is under a relatively dangerous environment, thereby improving the user's ability to identify dangers in the environment, solving the problem in the prior art that dangers may be brought to the wearer when the earphone is used, and improving the user's usage experience.

In addition, the embodiments of the present disclosure further provide an earphone, which achieves the beneficial effect of judging whether or not to perform an alert operation according to the wearer's current motion state, and improves the security when the user wears the earphone. In addition, the embodiments of the present disclosure provide an earphone control system which outputs reminder information from the wearable device to the wearer to remind the user, and outputs a control instruction to the earphone so that the earphone takes corresponding alert operation, thereby greatly enhancing the user's ability to identify any danger in the environment, and preventing the occurrence of dangers.

The above descriptions are just preferred embodiments of the present disclosure, rather than limitations to the protection scope of the present disclosure. Any amendment, equivalent replacement, improvement, etc. made within the spirit and principle of the present disclosure shall fall within the protection scope of the present disclosure.

The invention claimed is:

1. An earphone control method, comprising:

selecting a motion state judgement parameter of a wearer for controlling an earphone, and setting an alert condition according to the selected motion state judgement parameter;

real-timely monitoring and acquiring behavior data of the earphone wearer;

calculating, by a processor device, the motion state judgement parameter by using the acquired behavior data to obtain a motion state judgement parameter value; and judging, by the processor device, whether or not the motion state judgement parameter value satisfies the alert condition; if the motion state judgement parameter value satisfies the alert condition, determining to enter an earphone alert state and controlling to perform corresponding alert operation on the earphone;

and further comprising:

starting timing from a time moment of determining to enter an earphone alert state, and obtaining a current alert time length;

comparing, by the processor device, the current alert time length with a preset time threshold; if the current alert time length is larger than or equal to the time threshold, exiting the earphone alert state and cancelling corresponding alert operation; and if the current alert time length is less than the time threshold, keeping the alert state and further judging whether or not there is a motion state judgement parameter value satisfying the alert condition in the current alert time length; if so, recounting time from a current alert time point, or otherwise again comparing the current alert time length with the preset time threshold.

2. The method according to claim 1, wherein the selecting a motion state judgement parameter of a wearer for controlling an earphone, and setting an alert condition according to the selected motion state judgement parameter comprises:

selecting one or more of step speed, step frequency, step length and signal energy of the wearer as the motion state judgement parameter(s); and setting an alert threshold for each selected motion state judgement parameter, and setting the alert condition as that the motion state judgement parameter value is larger than the alert threshold.

3. The method according to claim 1, further comprising:

setting a plurality of different alert thresholds for each motion state judgement parameter, and setting alert conditions of different levels according to the different alert thresholds, wherein a first-level alert threshold and a second-level alert threshold are set for the motion state judgement parameter, the alert conditions include a first-level alert condition and a second-level alert condition, a motion state parameter value in the first-level alert condition is set to be larger than the first-level alert threshold and less than the second-level alert threshold, and a motion state parameter value in the second-level alert condition is set to be larger than the second-level alert threshold;

if the motion state judgement parameter value satisfies the alert condition, determining to enter an earphone alert state and controlling to perform corresponding alert operation on the earphone comprises:

if the motion state judgement parameter value satisfies the first-level alert condition, determining to enter a first-level alert state and controlling to perform corresponding alert operation on the earphone; and if the motion state judgement parameter value satisfies the second-level alert condition, determining to enter a second-level alert state and controlling to perform corresponding alert operation on the earphone.

4. The method according to claim 2, wherein the setting an alert threshold for each selected motion state judgement parameter, and setting the alert condition as that the motion state judgement parameter value is larger than the alert threshold comprises:

respectively setting a first-level alert threshold and a second-level alert threshold for a first motion state judgement parameter and a second motion state judgement parameter;

setting a first alert condition as that a first motion state judgement parameter value is larger than the second-level alert threshold, and a second motion state judgement parameter value is larger than the first-level alert threshold;

setting a second alert condition as that the first motion state judgement parameter value is larger than the first-level alert threshold and the second motion state judgement parameter value is larger than the second-level alert threshold;

wherein, the second-level alert threshold of the first motion state judgement parameter is larger than the first-level alert threshold of the first motion state judgement parameter, and the second-level alert threshold of the second motion state judgement parameter is larger than the first-level alert threshold of the second motion state judgement parameter;

if the motion state judgement parameter value satisfies the alert condition, determining to enter an earphone alert state and controlling to perform corresponding alert operation on the earphone comprises:

if the first motion state judgement parameter value and the second motion state judgement parameter value satisfy the first alert condition or the second alert condition, determining to enter an earphone alert state and controlling to perform corresponding alert operation on the earphone.

5. The method according to claim 2, wherein the real-timely monitoring and acquiring behavior data of the earphone wearer comprises:

real-timely monitoring and acquiring tri-axial acceleration data of motion behaviors of the earphone wearer through a tri-axial acceleration sensor, and/or real-timely monitoring and acquiring displacement data of the earphone wearer through a Global Positioning System (GPS) positioner.

6. The method according to claim 5, further comprising: disposing the tri-axial acceleration sensor at a position on the earphone contacting the wearer's head.

7. The method according to claim 5, wherein when the motion state judgement parameter is a step frequency, the calculating the motion state judgement parameter by using the acquired behavior data to obtain a motion state judgement parameter value comprises:

calculating a step number of the wearer by using the acquired tri-axial acceleration data, or X axis and Y axis acceleration data in the tri-axial acceleration data, calculating an average walking cycle of the wearer according to the step number and a signal sampling time duration, and calculating a first step frequency value according to the average walking cycle;

obtaining a second step frequency value by calculating the step number within a selected time duration by using the acquired tri-axial acceleration data or the X axis and Y axis acceleration data in the tri-axial acceleration data; and taking a smaller one of the first step frequency value and the second step frequency value as a step frequency motion state judgement parameter value.

8. The method according to claim 1, wherein the controlling to perform corresponding alert operation on the earphone comprises performing one or more of the following alert operations according to characteristics of the earphone:

lowering a noise cancellation level of Active Noise Cancellation (ANC) in the earphone;

increasing a gain of a Talk Through function of the earphone;

decreasing a volume of an audio played in the earphone; and outputting reminder information to the wearer.

9. An earphone, wherein an acceleration sensor or Global Positioning System (GPS) positioner is disposed at a position on the earphone contacting a wearer's head, and the earphone further comprises: an alert judgement unit connected to the acceleration sensor or GPS positioner, and an alert execution unit connected to the alert judgement unit;

the acceleration sensor or GPS positioner real-timely monitors and acquires behavior data of an earphone wearer;

the alert judgement unit calculates a selected motion state judgement parameter by using the acquired behavior data to obtain a motion state judgement parameter value, judges whether or not the motion state judgement parameter value satisfies a preset alert condition, and outputs a judgement result to the alert execution unit; and the alert execution unit determines to enter an earphone alert state and controls to perform corresponding alert operation on the earphone according to the judgement result, when the motion state judgement parameter value satisfies the alert condition; and to start timing from a time moment of determining to enter an earphone alert state, and to obtain a current alert time length; to compare the current alert time length with a preset time threshold; if the current alert time length is larger than or equal to the time threshold, exiting the earphone alert state and cancelling corresponding alert operation; and if the current alert time length is less than the time threshold, to keep the alert state and further judge whether or not there is a motion state judgement parameter value satisfying the alert condition in the current alert time length; if so, to recount time from a current alert time point, or otherwise again to compare the current alert time length with the preset time threshold.

10. An earphone control system, comprising an earphone and a wearable device wirelessly connected to the earphone;

the wearable device is provided with an acceleration sensor or Global Positioning System (GPS) positioner; and further comprises a processor connected to the acceleration sensor or GPS positioner, and a wireless transmitter and receiver unit connected to the processor;

the acceleration sensor or GPS positioner real-timely monitors and acquires behavior data of the earphone wearer, and outputs the behavior data to the processor;

the processor calculates a selected motion state judgement parameter by using the acquired behavior data to obtain a motion state judgement parameter value, judges whether or not the motion state judgement parameter value satisfies a preset alert condition, and when the motion state judgement parameter value satisfies the alert condition, determines to enter an earphone alert state, and sends an instruction of performing corresponding alert operation to the earphone while outputting reminder information to the earphone wearer; and starts timing from a time moment of determining to enter an earphone alert state, and obtains a current alert time length; compares the current alert time length with a preset time threshold; if the current alert time length is larger than or equal to the time threshold, exiting the earphone alert state and cancelling corresponding alert operation; and if the current alert time length is less than the time threshold, keeps the alert state and further judging whether or not there is a motion state judgement parameter value satisfying the alert condition in the current alert time length; if so, recounts time from a current alert time point, or otherwise again compares the current alert time length with the preset time threshold;

and the earphone receives the instruction of performing corresponding alert operation, and performs corresponding alert operation according to the instruction.

11. The earphone control system according to claim 10, wherein the performing corresponding alert operation comprises: lowering a noise cancellation level of Active Noise Cancellation (ANC) in the earphone, and/or increasing a gain of a Talk Through function of the earphone, and/or decreasing a volume of an audio played in the earphone; and the outputting reminder information to the earphone wearer comprises outputting reminder information indicating that the earphone enters the alert state onto a user interface of the wearable device, or outputting reminder information to the earphone wearer by intensifying a vibration alert or a ring alert of the wearable device.

12. The earphone control system according to claim 10, wherein the processor is specifically configured to select one or more of step speed, step frequency, step length and signal energy of the wearer as the motion state judgement parameter(s); and set an alert threshold for each selected motion state judgement parameter, and set the alert condition as that the motion state judgement parameter value is larger than the alert threshold.

13. The earphone control system according to claim 12, wherein the processor is further configured to set a plurality of different alert thresholds for each motion state judgement parameter, and set alert conditions of different levels according to the different alert thresholds, wherein a first-level alert threshold and a second-level alert threshold are set for the motion state judgement parameters, the alert conditions include a first-level alert condition and a second-level alert condition, a motion state parameter value in the first-level alert condition is set to be larger than the first-level alert threshold and less than the second-level alert threshold, and a motion state parameter value in the second-level alert condition is set to be larger than the second-level alert threshold;

the processor, if determining that the motion state judgement parameter value satisfies the first-level alert condition, determines to enter a first-level alert state, and sends an instruction of performing corresponding alert operation to the earphone while outputting reminder information to the earphone wearer; and the processor, if determining that the motion state judgement parameter value satisfies the second-level alert condition, determines to enter a second-level alert state, and sends an instruction of performing corresponding alert operation to the earphone while outputting reminder information to the earphone wearer.

14. The earphone control system according to claim 13, wherein the processor is specifically configured to set a first-level alert threshold for a first motion state judgement parameter, and set a second-level alert threshold for a second motion state judgement parameter;

set a first alert condition as that a first motion state judgement parameter value is larger than a second-level alert threshold, and a second motion state judgement parameter value is larger than the first-level alert threshold;

set a second alert condition as that the first motion state judgement parameter value is larger than the first-level alert threshold and the second motion state judgement parameter value is larger than the second-level alert threshold;

wherein, the second-level alert threshold of the first motion state judgement parameter is larger than the first-level alert threshold of the first motion state judgement parameter, and the second-level alert threshold of the second motion state judgement parameter is larger than the first-level alert threshold of the second motion state judgement parameter; and the processor, if determining that the first motion state judgement parameter value and the second motion state judgement parameter value satisfy the first alert condition or the second alert condition, determines to enter the earphone alert state, and sends an instruction of performing corresponding alert operation to the earphone while outputting reminder information to the earphone wearer.

* * * * *